US006395137B1

(12) United States Patent
Snellman

(10) Patent No.: US 6,395,137 B1
(45) Date of Patent: May 28, 2002

(54) SEAL CONSTRUCTION FOR A SUCTION BOX IN A SUCTION ROLL IN A PAPER/BOARD MACHINE

(75) Inventor: Jorma Snellman, Jyväskylä (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/529,889

(22) PCT Filed: Oct. 22, 1997

(86) PCT No.: PCT/FI98/00820

§ 371 (c)(1),
(2), (4) Date: Jul. 10, 2000

(87) PCT Pub. No.: WO99/20832

PCT Pub. Date: Apr. 29, 1999

(30) Foreign Application Priority Data

Oct. 22, 1997 (FI) ..... 974023

(51) Int. Cl.[7] ..... D21F 3/10
(52) U.S. Cl. ..... 162/371; 162/369; 277/583
(58) Field of Search ..... 162/368, 369, 162/370, 371; 277/345, 583, 578, 589

(56) References Cited

U.S. PATENT DOCUMENTS 712,664 A * 11/1902 Gage ..... 162/371
2,649,719 A * 8/1953 Hornbostel ..... 162/371
2,900,024 A * 8/1959 Holcroft ..... 162/371
3,802,961 A * 4/1974 Grass et al. ..... 162/371
5,580,424 A 12/1996 Snellman ..... 162/371
5,975,532 A * 11/1999 Karttunen et al. ..... 162/371

FOREIGN PATENT DOCUMENTS

WO 9717490 5/1997

* cited by examiner

*Primary Examiner*—Karen M. Hastings
(74) *Attorney, Agent, or Firm*—Steinberg & Raskin, P.C.

(57) ABSTRACT

The invention concerns a seal construction for a suction roll in a paper machine. The seal construction (10) comprises a substantially U-section holder (12) open towards the inner face (3) of the roll mantle, a seal which is mounted in the holder, which is placed in the axial direction of the roll, and which consists of a frame part (13) of the seal fitted in the holder (12) and of a wear part (11), which is fix to the frame part and which is placed against the inner face (3) of the roll mantle, and which seal construction also comprises loading means, such as a loading hose (15) or equivalent, by whose means the seal can be shifted in the holder (12) against the inner face (3) of the roll mantle. According to the invention, in the interior of the frame part (13) of the seal, an inner loading member (16) has been arranged, by whose means the frame part of the seal can be locked in contact with the holder (12) so as to position the wear part (11) of the seal in the desired position in relation to the inner face (3) of the roll mantle.

13 Claims, 5 Drawing Sheets

SEAL CONSTRUCTION FOR A SUCTION BOX IN A SUCTION ROLL IN A PAPER/BOARD MACHINE

FIELD OF THE INVENTION

The invention concerns a seal construction for a suction box in a suction roll in a paper machine.

BACKGROUND OF THE INVENTION

Wear of seals in suction rolls has become a problem in an attempt to achieve longer servicing intervals. In a prior-art solution, in view of providing an efficient and tight suction roll, the seals are pressed by means of compressed air against the inner face of the roll mantle. In such a case, the compression force is maintained constantly, and the seal wears rapidly. In the present patent application, an efficient solution is suggested in order to avoid wear of the seal. According to the present invention, the seal rib is provided with a locking device. The seal is first pressed against the roll mantle. After generation of a vacuum in the suction box, the pressure is eliminated from the seal loading means, and the seal is locked in its holder. With the arrangement in accordance with the invention, even the water lubrication can be omitted. Further, the seals can be provided with inclined faces, which permit gradual equalization of the pressures in the perforations in the suction roll as the perforations in the roll depart from the area of vacuum along with the rotation of the roll.

The prior art related to the present invention is represented by the applicant's earlier FI Patent Application No. 934909, in which the main principle of the invention on the whole is protected, i.e. carrying out a locking of the seal rib.

OBJECTS AND SUMMARY OF THE INVENTION

In the present new patent application, a precise, optimal solution is described for providing a locking construction. In the present invention, a locking construction is employed in which all the constructions for carrying out the locking are placed in the seal rib itself. Thus, no separate alterations have to be made in the seat.

In accordance with the present invention, as the device for locking of the seal, a separate loading device is employed, favourably a hose operating by means of air pressure. The hose has been fitted between the seal and the holder on the bottom of a groove provided in the seal. According to the invention, said hose is placed in connection with a separate piston part. At the opposite side of the seal, there is a separate rib, which is pressed against the wall of the holder. In connection with said rib, there are seal bands. The piston part and said separate rib are favourably made of reinforced plastic, such as fibreglass epoxy resin or fibreglass phenol resin or PE plastics.

The seal 10 itself consists of two component frames: a base frame 10*a* and a wear frame 10*b*. On the top of the base frame 10*a*, there is a separate wear frame 10*b* as the contact frame, which wear frame can be made of rubber graphite, carbon graphite, or plastics, such as PE, PC, PPF, PEEK, or PFTE plastic or phenol resin. The construction may further include fibre reinforcements, such as carbon fibres, glass fibres, aramide fibres, and it may also contain graphite powder. Said separate wear frame has been fixed to the base frame by gluing. The wear frame has also been attached to the base frame by means of a dovetail joint.

The seal construction in accordance with the invention for a suction box in a suction roll in a paper/board machine is characterized in what is stated in the patent claims.

BRIEF DESCRIPTION OF THE DRAWINGS

The invention will be described in the following with reference to some preferred embodiments of the invention illustrated in the figures in the drawings, the invention being, however, not supposed to be confined to said embodiments alone.

DETAILED DESCRIPTION OF THE INVENTION

Figure 1A:
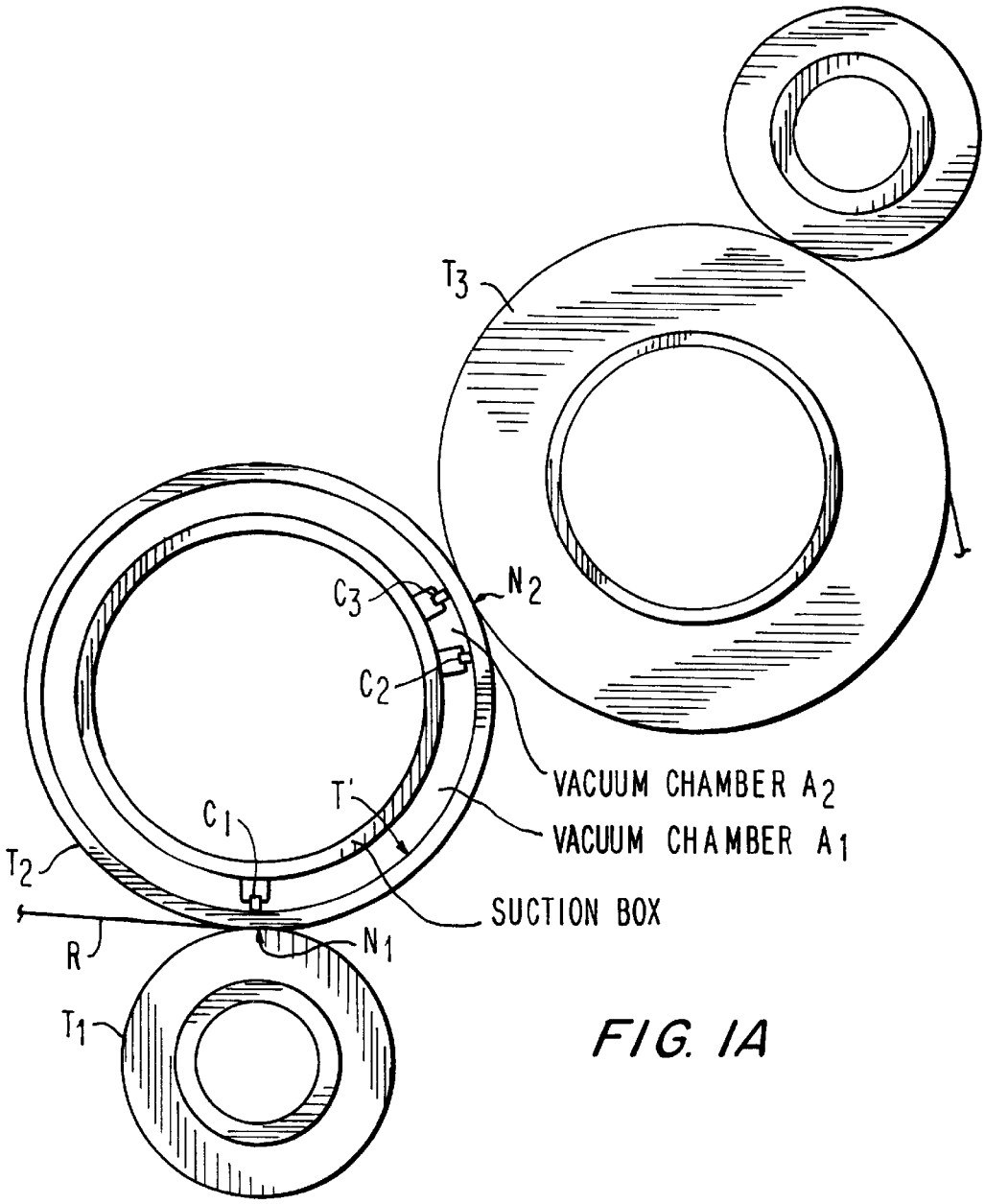
FIG. 1A illustrates a suction roll in a paper machine by whose means water is removed out of the web.

FIG. 1A shows a prior-art operation of a suction roll in a paper machine. The web R is passed through the nip $N_1$ between the rolls $T_1$ and $T_2$ along the face of the roll $T_2$ into the nip $N_2$ between the rolls $T_2$ and $T_3$. In the interior of the roll $T_2$, there are a vacuum chamber $A_1$ and a vacuum chamber $A_2$. The vacuum chamber $A_1$ is placed between the seals $C_1$ and $C_2$, and the vacuum chamber $A_2$ between the seals $C_2$ and $C_3$. Thus, water is sucked out of the web R into the vacuum chambers A1, $A_2$. In said prior-art operation, the seals $C_1$, $C_2$ and $C_3$ are pressed constantly against the inside face $T_2'$ of the roll $T_2$ mantle with a force produced by loading hoses.

Figure 1B:
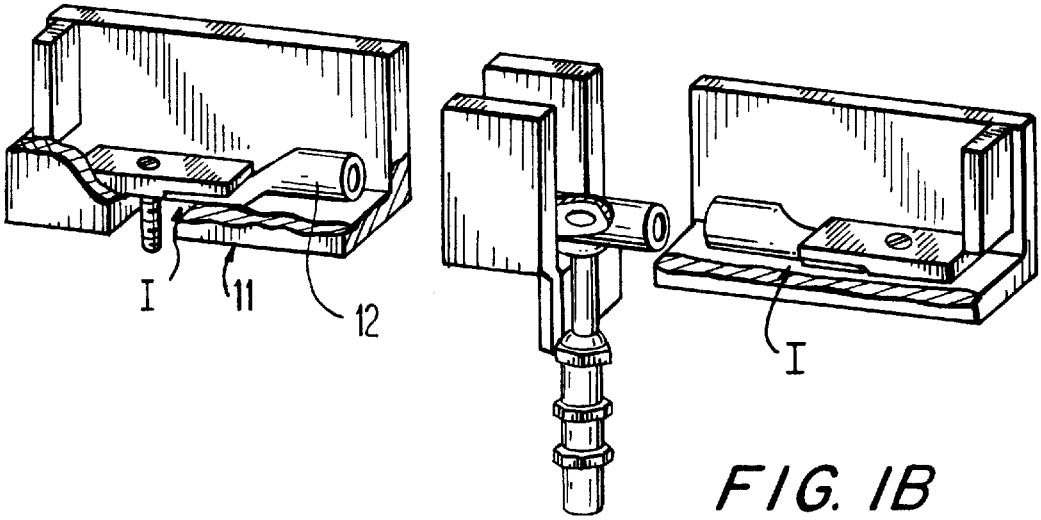
FIG. 1B shows a seal holder for prior-art operation of a seal together with a loading hose placed on the bottom of the seal holder.

FIG. 1B illustrates the prior-art holder construction 11 for the seals $C_1$, $C_2$, $C_3$ shown in FIG. 1A. The seal (not shown in the figure) is pressed with a force, by means of the air pressure produced in the loading hose 12, against the inner face $T_2$' of the roll mantle of the roll $T_2$.

Figure 1C:
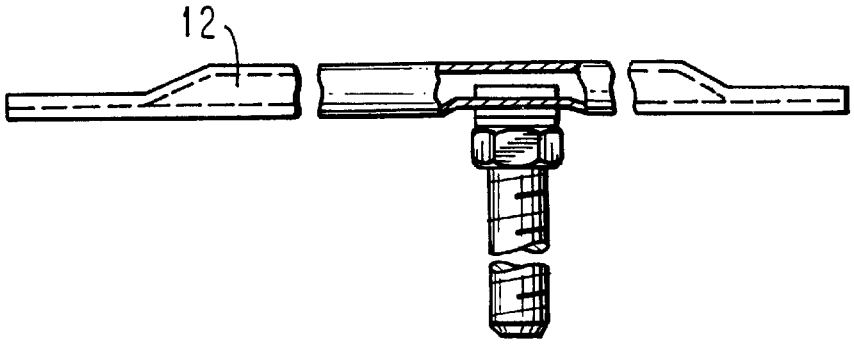
FIG. 1C is a sectional view taken along the line I—I in FIG. 1B.

FIG. 1C is a sectional view taken along the line I—I in FIG. 1B.

In the prior-art solutions illustrated in FIGS. 1A . . . 1C, the seals $C_1$, $C_2$ and $C_3$ are pressed constantly with a force against the inner face of the roll mantle of the revolving roll. The seals $C_1$, $C_2$ and $C_3$ wear rapidly even if they were lubricated with water during the operation of the roll.

Figure 2A:
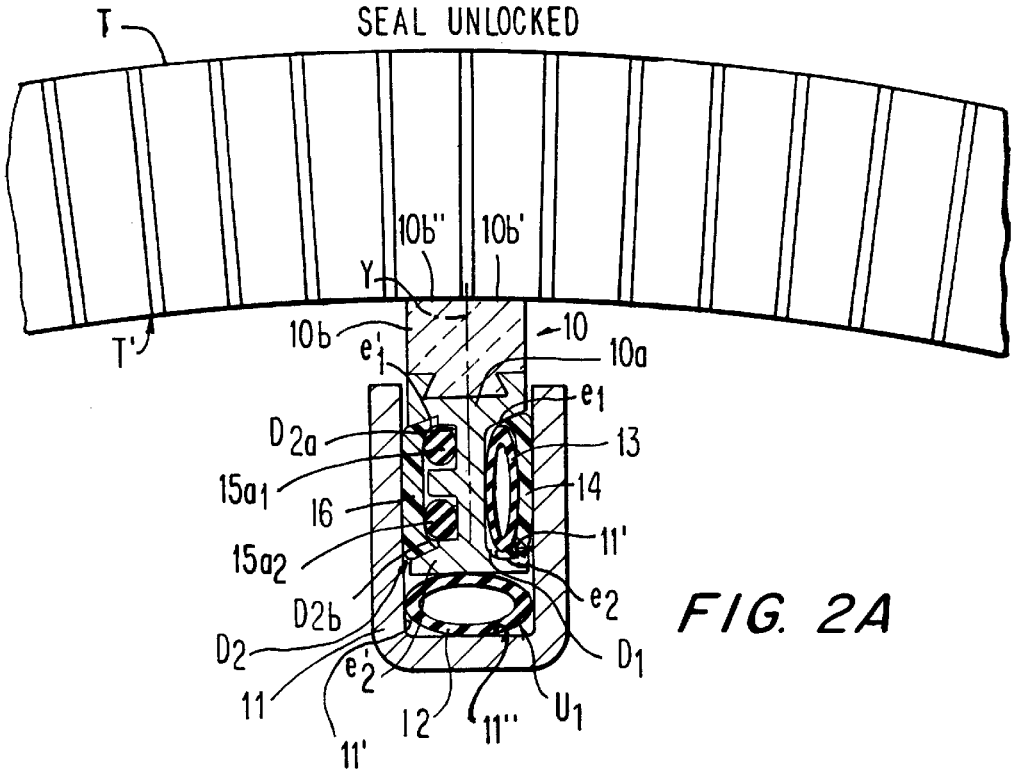
FIG. 2A shows a locking construction between a seal in accordance with the invention and the seal holder as a sectional view of the seal rib. In the embodiment shown in FIG. 2A, the seal has been pressed against the inner face of the roll.

FIG. 2A shows the seal construction in accordance with the invention in a stage in which the pressing and locking of the seal 10 against the inner face 11' of the holder 11 has not yet been carried out by means of the locking devices. Based on FIG. 2A, the seal construction in accordance with the invention will be described. As is shown in FIG. 2A, the seal construction comprises a seal 10 in the seal groove U in a holder 11. In the embodiment shown in FIG. 2A, the seal 10 comprises a base frame 10*a* and a wear frame 10*b*. As is shown in the figure, the wear frame 10*b* has been fixed to the base frame 10*a* by gluing and by means of a dovetail joint f. The seal 10 is an oblong rib-like part, which extends substantially over the entire length of the roll. The base frame 10*a* comprises oblong cavities or spaces $D_1$ and $D_2$ in both of its side faces. In the figure, into the right-side cavity or space $D_1$, a loading member 13, preferably a loading hose, has been fitted, which can be loaded by means of air pressure, which pressure can be passed into the loading hose. The loading hose 13 has been fitted in connection with the space $D_1$ so that the loading hose 13 rests against the end wall $D_1$' of the space $D_1$, on one hand, and against a displaceable piston part 14, on the other hand. During loading of the hose, the piston part 14 can be pressed against the wall 11' of the holder 11. The piston 14 has been fitted in the space $D_1$ with glide fitting, i.e. it can be made to glide in relation to the side walls, i.e. the top and bottom face $e_1$, $e_2$, of the space. When the seal 10 is locked in relation to the seat 11, the holder 11 is first pressed with the force, produced by the loading hose 12 placed between the seal 10 and the bottom 11" of the holder 11, against the inner face T' of the roll mantle. When the desired vacuum level has been reached, the loading pressure is removed from the hose 12. After this, locking is performed by means of the loading device 13, preferably a loading hose, by shifting the seal 10 laterally against the wall 11' of the holder 11. Said shifting is carried out by the loading hose 13 so that it shifts the piston part 14 against one vertical wall 11' of the holder 11. Thus, the seal 10 is locked between two vertical walls of the holder 11 while the piston part is pressed against one wall of the holder 11 and while the side seal placed at the other side is pressed with the force produced by the loading hose 13 against the other vertical wall 11' of the holder 11.

As is shown in the figure, at the other side of the base frame 11*a* of the seal 11 there is a cavity $D_2$, which consists of two parts and comprises the spaces $D_{2a}$, $D_{2b}$. In each of said cavity portions $D_{2a}$ and $D_{2b}$ there is a resilient element, which is preferably an oblong seal band 15$a_1$, 15$a_2$. Against each of said seal bands 15$a_1$, 15$a_2$, a separate rib 16 is supported, which is placed in the area of the cavities $D_{2a}$ and $D_{2b}$ and one of whose sides rests against the seal bands 15$a_1$, 15$a_2$, whereas the other plane side rests against the inner face 11' of the vertical wall of the holder 11. Thus, the rib 16 can be shifted by means of a glide fitting in relation to the side walls, i.e. the top and bottom face $e_1$' and $e_2$', of the cavity $D_2$.

On the bottom of the cavity $U_1$, there is a loading device 12, favourably a loading hose, which can be loaded by means of pressure produced in its interior, preferably air pressure. In such a case, the shape of the loading hose 12 can be varied, and the face 10*b*′ of the wear frame 10*b* of the seal 10 can be displaced with force against the inner face T' of the roll T mantle.

As is shown in FIG. 2A, the top and bottom faces $e_1$,$e_2$,$e_1$',$e_2$' of both of the cavities $D_1$ and $D_2$ are inclined in the same direction in relation to the central and vertical axis Y of the seal 10. When the locking is carried out, the seal 10 is shifted in the lateral direction. When the seal 10 is locked, first the seal 10 is pressed by means of the loading hose 12 placed on the bottom of the groove $U_1$ in the holder 11 against the inner face T' of the roll mantle. When the desired vacuum level has been reached, the pressure is removed from the loading hose 12/loading hoses 12$a_1$, 12$a_2$. After this, the loading device 13, preferably a loading hose, is employed, and by its means the piston part 14 is pressed into contact with the wall 11' of the holder 11, and the seal 10 is locked in relation to the holder 11, in which connection the seal 10 is kept in its place in relation to the holder 11 by means of the pressure produced in the loading hose 13. Thus, the seal 10 remains precisely locked in a certain position. The top and bottom faces $e_1$,$e_2$;$e_1$',$e_2$' of the cavities $D_1$ and $D_2$ are in such a way inclined in relation to the central axis Y that in the cavity $D_1$ the top and bottom faces $e_1$ and $e_2$ rise towards the roll T when moving from the end of the cavity $D_1$ to the mouth of the cavity, and in the cavity $D_2$ the top and bottom faces $e_1$',$e_2$' are lowered in relation to the roll T when moving from the bottom of the cavity $D_2$ to its mouth. Thus, when the piston part 14 is displaced, the seal 10 is guided by means of said top and bottom faces $e_1$,$e_2$;$e_1$', $e_2$' so that its front face 10*b*' is guided apart from the inner face T' of the roll mantle.

Figure 2B:
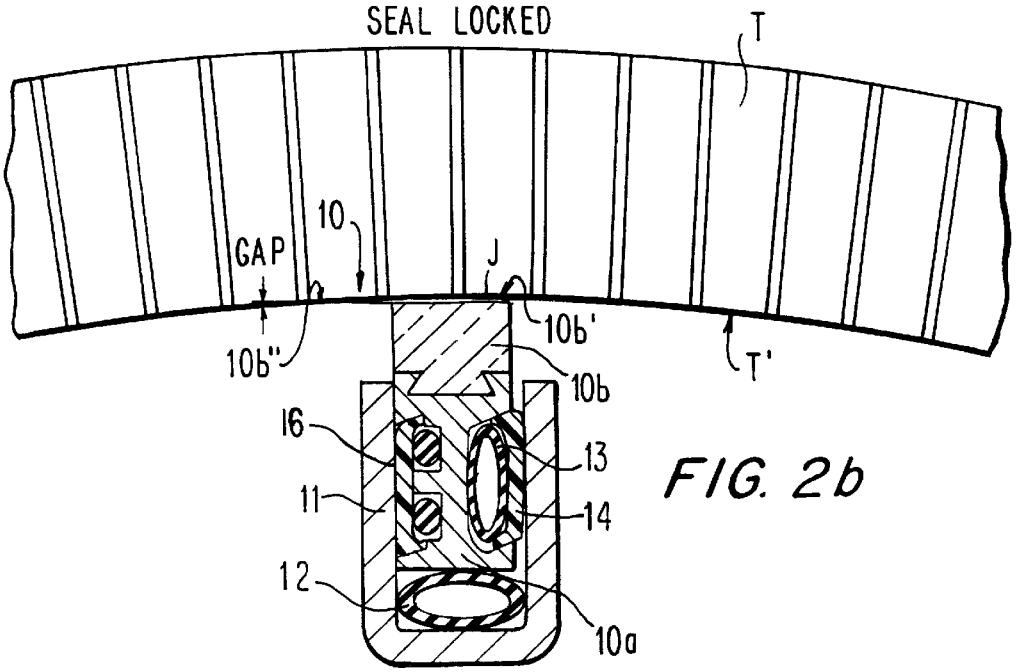
FIG. 2B shows a stage of locking in which the locking has been accomplished, in which case the top face 10' of the seal 10 is preferably placed slightly apart from the roll mantle. The gap is, however, so little that no significant leakage occurs. In such a case, the wear of the seal has been minimized, while the sealing effect of the seal has, however, been maximized.

Thus, when a loading hose 13 is used for locking, the gap J shown in FIG. 2B can be produced between the front face 10*b*' of the wear frame 10*b* of the seal 10 and the inner face T' of the roll T mantle.

In the following, the optimal materials will be stated for a seal 10 in accordance with the present invention:

The material of the wear frame 10*b* of the seal 10 can be favourably as follows: rubber graphite, carbon graphite, or, for example, the following plastics: PE or PU or PPS or PEEK or PTFE or phenol resin. It is also possible to use fibre reinforcements, such as carbon fibre or glass fibre or aramide fibre, and, as an additive, lubricating graphite powder or PTFE or molybdenum sulphide.

Figure 3:
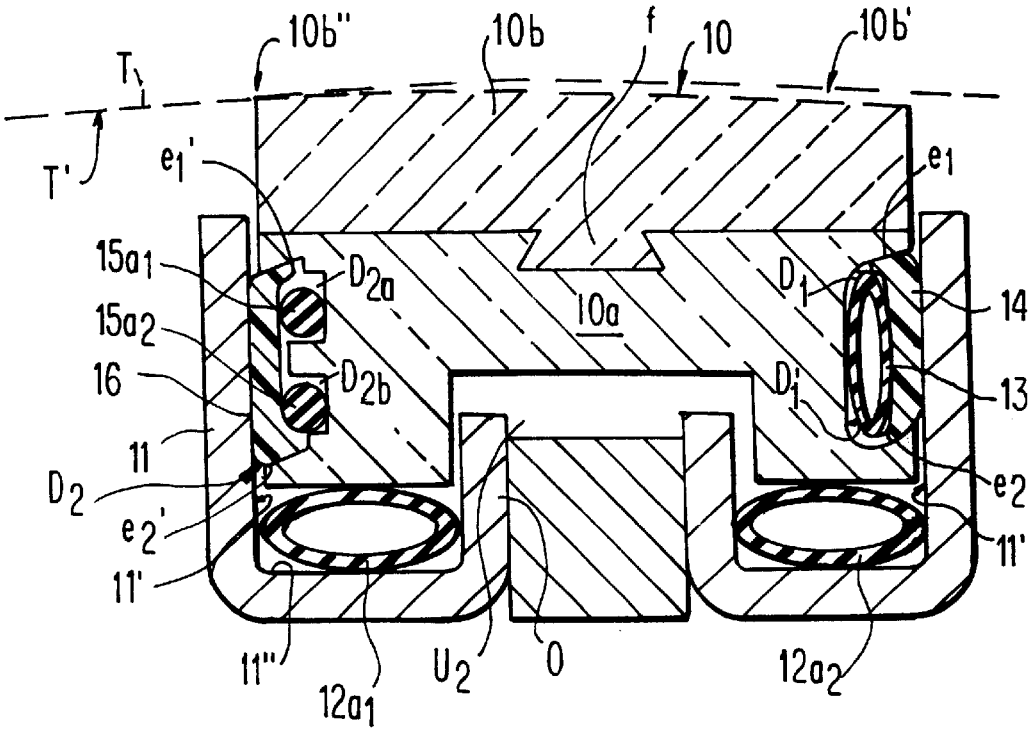
FIG. 3 shows an embodiment of the invention in which there are two loading hoses between the bottom of the holder and the seal.
Figure 4A:
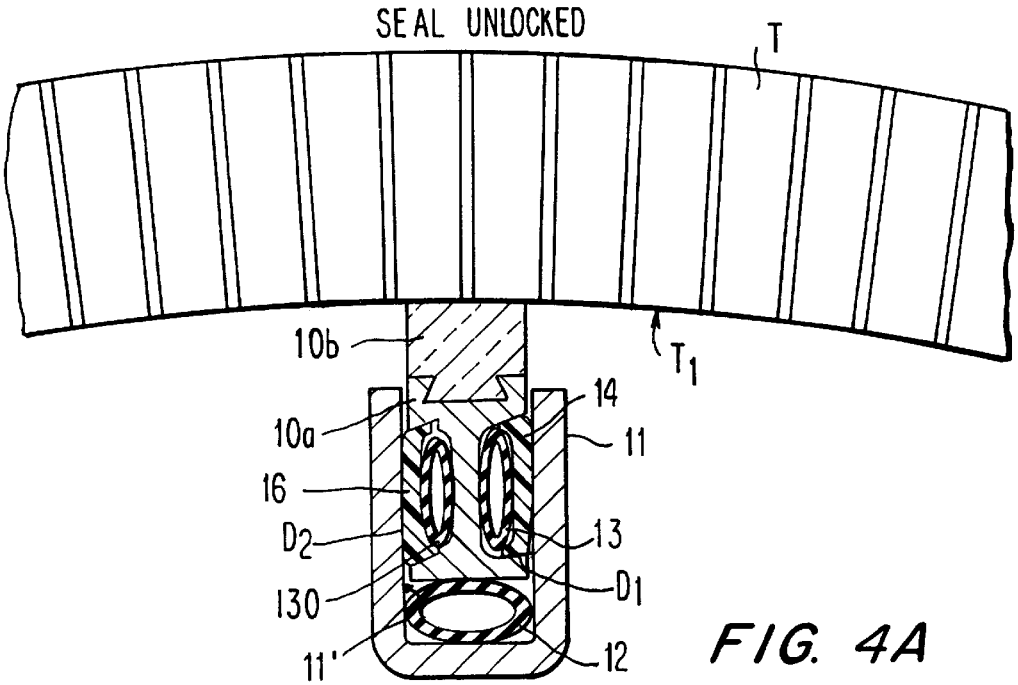
FIG. 4A shows an embodiment of the seal construction in accordance with the invention in which there is a loading hose at each side of the seal.
Figure 4B:
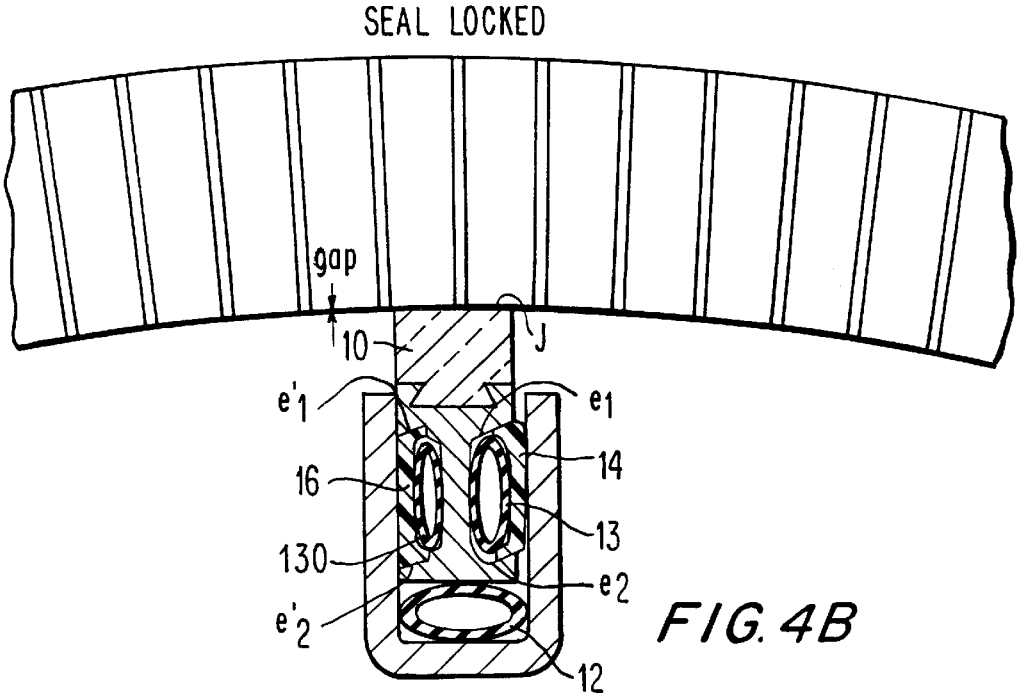
FIG. 4B shows the operation of the seal construction as shown in FIG. 4A in the stage in which the gap J has been formed between the seal and the inner face of the roll mantle after locking of the seal carried out by means of the loading hoses placed at both sides of the seal.

The material of the base frame part 10*a* of the side seal 10 and of the piston 14 is favourably:

reinforced plastics: fibreglass epoxy resin or fibreglass phenol resin or PE plastics. FIG. 3 shows a second embodiment of the invention, which differs from the embodiment shown in FIGS. 2A and 2B in the respect only that there are two loading hoses 12 that press the seal 10 towards the roll, i.e. $12a_1$ and $12a_2$. Further, the base frame 10*a* of the seal 10 comprises an oblong lower groove $U_2$, in which case the central shoulder O of the holder 11, which extends upwards, operates as a guide shoulder in order to guide the seal 10 towards the roll mantle T when the loading hoses $12a_1$,$12a_2$ are operated. FIGS. 4A and 4B show an embodiment of the invention in which the seal bands $15a_1$ and $15a_2$ have been substituted for by a resilient loading hose 130. FIG. 4A shows an embodiment in which the seal has been pressed against the inner face of the perforated roll mantle, and FIG. 4B shows a stage in which the gap J has been formed between the seal 10 and the inner face T' of the roll mantle T. The loading hose 130 is placed in a cavity $D_2$ in one side face of the seal, and the loading hose 13 is placed in a cavity $D_1$ in the other side face of the seal. In the cavity $D_2$ there is a rib 16. The rib can be displaced with a glide fitting in relation to the wall of the cavity $D_2$. Similarly, the rib 14 can be displaced with a glide fitting in relation to the wall of the cavity $D_1$. In the embodiment shown in FIGS. 4A and 4B, the function of the loading hoses 13,130 is to operate, besides as loading elements, also as springs which permit relative movements between the rib 16 and the seal 10 and between the rib 14 and the seal 10 during locking. The top and bottom faces $e_1$,$e_2$;$e_1$',$e_2$' of the cavities $D_1$ and $D_2$ are inclined in the same way as, for example, in the embodiment shown in FIG. 2A. By means of the resilient elements, i.e. the hoses 13,130 in the embodiment shown in FIGS. 4A and 4B, the locking force produced by means of said elements is transferred to the ribs 16 and 14. Thus, a friction force arises between the ribs 16 and 14 and the holder 11. When a gap J is supposed to be formed between the seal 10 and the inner face T' of the roll mantle T, the friction force between said locking means and the holder must be higher than the vacuum force at the top face of the seal. Formation of said gap J, however, requires that the seal 10 moves, when pushed by the locking member 13, in relation to the rib 16 and 14 also after a sufficient friction force has been reached between the locking means and the holder 11. Said movement is permitted by the elastic compression of the seal elements, for example the seal bands $15a_1$,$15a_2$ or the loading hose 130, which compression has been produced by the locking force. If there were no such elastic elements $15a_1$,$15a_2$,130, a locking force would not be produced until when the ribs 16 contact the bottom of the related cavity, after which no more relative movement would take place between the seal and the locking means, in which case no gap J would be produced either between the seal 10 and the inner face T' of the roll mantle T. Preferably, the cross-sectional area of the loading hose 13 is larger than that of the loading hose 130. The force is applied to the seal 10 so that it is pressed towards one side 11' of the holder, i.e. to the left as shown in FIG. 4B.

What is claimed is:

1. A seal construction for a suction box in a suction roll in a paper/board machine, which seal construction comprises a seal (10) placed in a holder (11) and a first loading means including at least a first loading hose (12; $12a_1$; $12a_2$) arranged between the holder (11) and the seal (10), in which connection the seal (10) is pressed against the inner face (T) of the roll mantle of the suction roll (T) by means of the pressure of a medium passed into the loading hose (12; $12a$,$12a2$), locking means (13,14,16) by whose means the seal (10) can be locked in a desired position in the holder (11), said loading means a including (14) arranged in a cavity ($D_1$) located within one side face of the seal (10), a second loading hose (13) for applying a force upon said rib (14), said second loading (13) arranged within the cavity ($D_1$), a second rib (16) arranged within a cavity/cavities ($D_2$, $D_{2a}$, $D_{2b}$)provided in an opposite side face of the seal (10), and a resilient element (130, $15a_1$, $15a_2$) arranged in said cavity/cavities ($D_2$, $D_{2a}$, $D_{2b}$) between said second rib (16) and said seal (10).

2. A seal construction as claimed in claim 1, for a suction box in a suction roll in a paper/board machine, wherein the resilient element is a third hose (130).

3. A seal construction as claimed in claim 1, wherein the resilient element is seal bands ($15a_1$, $15a_2$) placed in the cavities ($D_{2a}$, $D_{2b}$).

4. A seal construction as claimed in claim 1, for a suction box in a suction roll in a paper/board machine, wherein the second loading hose (13) is arranged in the cavity ($D_1$) so that it is positioned between an end ($D_1$') of the cavity ($D_1$) and a separate piston part (14) arranged in the cavity ($D_1$), and wherein the cavity ($D_1$) is provided with bottom and top faces ($e_1$, $e_2$) which are inclined in relation to the central axis (Y-axis) of the seal (10) and guide the piston part (14), and, in a corresponding way, cavity ($D_2$) is provided with top and bottom faces ($e_1$, $e_2$) for rib (16) which are inclined in relation to the central axis (Y) of the seal (10).

5. A seal construction as claimed in claim 1, for a suction roll in a paper/board machine, wherein a wear frame (10*b*) of the seal (10) is fixed to a base fame (10*a*) of the seal (10) by means of one of a dovetail joint (f) and an adhesive.

6. A seal construction as claimed in claim 1, for a suction box in a suction roll in a paper/board machine, wherein said first loading hose (12) is arranged between a bottom (11") of the holder (11) and a bottom of the base frame (10*a*) of the seal (10).

7. A seal construction as claimed in claim 1 for a suction box in a suction roll in a paper/board machine, wherein, on a bottom (11") of the holder (11), there is shoulder (O) that extends upwards, and that, in a base frame (10*a*) of the seal (10), on its bottomm there is a groove ($U_2$), which surrounds said shoulder (O), the seal (10) being guided by means of side faces of the shoulder (O), and wherein said at least a first loading hose (12; $12a_1$; $12a_2$) comprises two loading hoses ($12a_1$, $12a_2$) each one being arranged on a respective side of said shoulder (O) whereby the seal (10), can be pressed against the inner face (T') of the roll mantle.

8. A seal construction for a suction box in a suction box of a paper/board machine, said seal construction comprising:

a sealing member having at least one side recess;

a holder member for receiving said sealing member;

locking means for selectively locking said sealing member in a selected position in said holder member, said locking means including at least one loading hose arranged between said holder member and said sealing member in said at last one side recess;

wherein said sealing member comprise a first side recess and a second side recess; and wherein said locking means comprises a first rib arranged in said first side recess between said loading hose and said holding member and a second rib arranged in said second side recess between a resilient element and said holding member.

9. A seal construction as claimed in claim 8, wherein said resilient element comprises a seal band.

10. A seal construction as claimed in claim 8, wherein each of said first and second side are defined in part by interior top and bottom faces of said sealing member, said top and bottom faces being inclined in relation a central axis of said sealing member.

11. A seal for a suction box in a suction roll in a paper/board machine, comprising:

a wear fame (10*b*) structured and arranged to be affixed atop a base frame (10*a*), said base frame (10*a*) having a first cavity ($D_1$) formed in a first side thereof, said first cavity ($D_1$) being structured and arranged to receive a locking means for said seal (10) therein;

at least one groove ($D_{2a}$, $D_{2b}$) being formed in a second side of said base frame (10*a*), said at least one groove ($D_{2a}$, $D_{2b}$) being structured and arranged to receive at least one seal band therein, wherein said second side being opposite said first side of said base frame (10*a*);

a second cavity ($D_2$) formed on said second side of said base frame (10) having a top and a bottom face ($e_1'$, $e_2'$);

a rib (16) structured and arranged to cooperate with and abut against at least one of said seal bands on said second side of said base frame (10) and to be guided between said top and bottom faces ($e_1'$, $e_2'$), wherein said top and bottom faces ($e_1'$, $e_2'$) are inclined in relation to a central axis (Y) of said seal (10).

12. A seal as in claim 11, wherein said wear frame (10*b*) of said seal (10) is affixed to said base frame (10*a*) of said seal (10) by means of at least one of a dove tail joint (f) and means of an adhesive.

13. A seal as in claim 11, further comprising:

a groove ($U_2$) formed in a bottom surface of said base frame (10*a*) of said seal (10).

* * * * *